US010273550B2

(12) United States Patent
Hua et al.

(10) Patent No.: US 10,273,550 B2
(45) Date of Patent: Apr. 30, 2019

(54) ULTRASOUND-ASSISTING QUENCHING PROCESS AND DEVICE FOR PERFORMING THE SAME

(71) Applicant: WUHAN UNIVERSITY OF TECHNOLOGY, Wuhan (CN)

(72) Inventors: Lin Hua, Wuhan (CN); Yanxiong Liu, Wuhan (CN); Xiaowen Wang, Wuhan (CN); Zhou Wang, Wuhan (CN); Wuhao Zhuang, Wuhan (CN)

(73) Assignee: WUHAN UNIVERSITY OF TECHNOLOGY, Wuhan, Hubei (CN)

( * ) Notice: Subject to any disclaimer, the term of this patent is extended or adjusted under 35 U.S.C. 154(b) by 829 days.

(21) Appl. No.: 14/760,427

(22) PCT Filed: Nov. 28, 2013

(86) PCT No.: PCT/CN2013/088035
§ 371 (c)(1),
(2) Date: Jul. 10, 2015

(87) PCT Pub. No.: WO2015/000252
PCT Pub. Date: Jan. 8, 2015

(65) Prior Publication Data

US 2015/0344984 A1 Dec. 3, 2015

(30) Foreign Application Priority Data

Jul. 5, 2013 (CN) ..... 2013 1 0280573

(51) Int. Cl.
*C21D 1/04* (2006.01)
*C21D 1/62* (2006.01)
(Continued)

(52) U.S. Cl.
CPC ..... *C21D 1/04* (2013.01); *C21D 1/62* (2013.01); *C21D 1/63* (2013.01); *C21D 11/005* (2013.01); *C21D 1/18* (2013.01)

(58) Field of Classification Search
CPC ..... C21D 1/04
(Continued)

(56) References Cited

U.S. PATENT DOCUMENTS 4,030,947 A 6/1977 Kemper

FOREIGN PATENT DOCUMENTS

CN 101956051 1/2011
CN 103333995 10/2013
(Continued)

OTHER PUBLICATIONS

Fu, "Five hundred questions about wear-resistant material," 2011, China Machine Press, pp. 152-153 (Explanation of relevance provided in English translation of NPL document 2).
(Continued)

*Primary Examiner* — Brian D Walck
(74) *Attorney, Agent, or Firm* — Hamre, Schumann, Mueller & Larson, P.C.

(57) ABSTRACT

An ultrasound-assisting quenching process includes: S1) connect the workpiece with the ultrasonic unit tightly; S2) heat the workpiece to the quenching temperature and then hold for a period of time; S3) start the ultrasonic unit, then the ultrasound energy can be injected into the workpiece directly; and S4) put the workpiece into the coolant quickly to make the workpiece to be quenched. The device for this process mainly includes the ultrasonic unit and a heating unit. This invention inputs the ultrasound energy into the workpiece during the quenching process. Under the action of the ultrasound, the grain size of the workpiece after quenching process will be much smaller compared with the
(Continued)

conventional quenching process. Therefore, the ultrasound-assisting quenching process can improve the strength and plasticity of the material, and extend the life of the workpiece.

1 Claim, 1 Drawing Sheet

(51) Int. Cl.
*C21D 1/63* (2006.01)
*C21D 11/00* (2006.01)
*C21D 1/18* (2006.01)

(58) Field of Classification Search
USPC ..... 148/558
See application file for complete search history.

(56) References Cited

FOREIGN PATENT DOCUMENTS

| | | |
|---|---|---|
| JP | 06-128624 | 5/1994 |
| JP | 2001-294938 | 10/2001 |

OTHER PUBLICATIONS

Office Action from corresponding Chinese patent application, dated Apr. 23, 2014 and English language translation, 12 pages total.
Notification to Grant issued in corresponding Chinese patent application, dated Sep. 4, 2014 and English language translation, 3 pages total.
International Search Report for PCT/CN2013/088035 dated Apr. 3, 2014 and English language translation, 6 pages total.

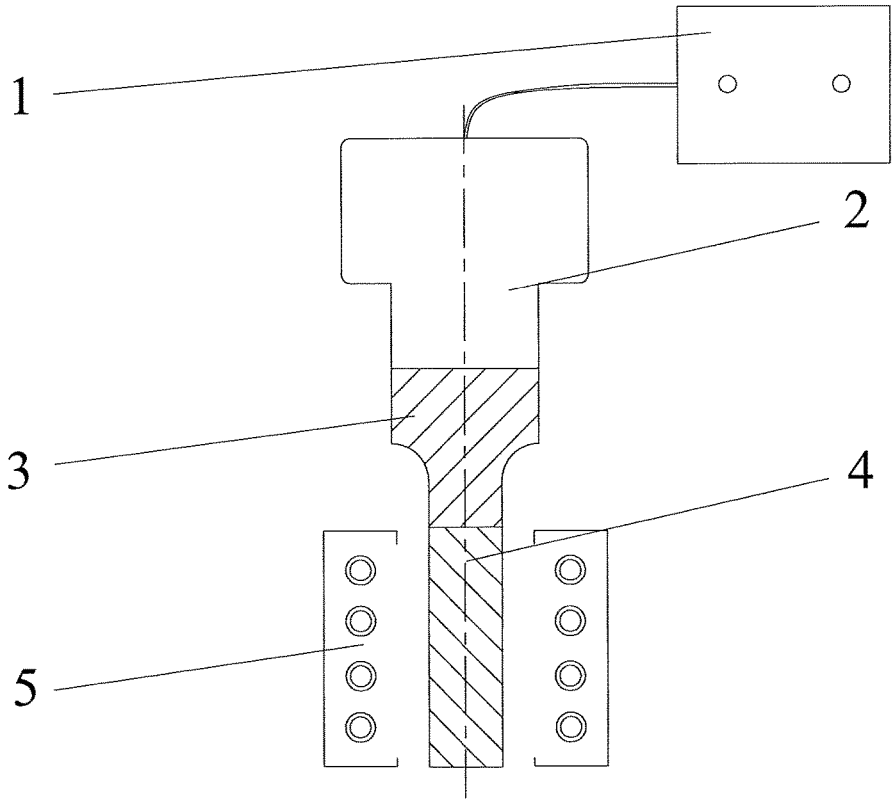
1
2
3
4
5

ULTRASOUND-ASSISTING QUENCHING PROCESS AND DEVICE FOR PERFORMING THE SAME

FIELD

This disclosure relates to the field of heat treatment, and specifically, relates to an ultrasound-assisting quenching process and a device that performs the process.

BACKGROUND

Quenching is a kind of heat treatment process, in which the workpiece is heated to a temperature and preserved for a period of time, and then put into the coolant quickly. Quenching process can improve the hardness and wear resistance of the workpiece. Therefore, the quenching process has been applied to various kinds of tool, die, measuring device and the parts which required high surface wear resistance such as gear, roller and so on. Moreover, some steel with special property can get particular physical and chemical properties by quenching processes, e.g. the ferromagnetic property of permanent magnetic steel can be strengthened, and the corrosion resistance of the stainless steel can be enhanced.

Quenching process is mainly used for the steel parts. The mechanism of quenching process for the steel parts is that: when the material was heated up to a critical temperature, all or most of the microstructure will be transformed to the austenite. Then, the steel parts are put into the coolant to be cooled quickly, and the austenite will be transformed to martensite or bainite. Generally, the parts have to be tempered after the quenching process to improve the tensile strength, hardness, wear resistance, fatigue strength and toughness, and then to meet the various requirement of the parts and tool. Quenching process has been widely used in the modern mechanical manufacturing area. Almost all of the important parts used in the machine, especially in the automotive, airplane and rocket area, should be quenched.

Applying the additional energy field into the quenching process can improve the quenching effect. So far, the research is just concentrated on the electromagnetic field. For the carbon steel and low alloy steel material, martensite is ferromagnetic phase, and the austenite is paramagnetic phase. Under the action of the magnetic field, the free energy of the martensite will be decreased due to the magnetization. Therefore, the magnetic field can improve the transformation of the austenite to the martensite. Moreover, the lamellar martensite has the magnetostriction under the action of magnetic field because the misorientation of the lamellar martensite is different, which cause the lattice of the martensite phase and austenite phase to be distorted. This elastic distortion energy can also improve transformation of the austenite to the martensite and increase the nucleation rate of the martensite. Therefore, the electromagnetic energy can refine the martensite and decrease the content of retained austenite.

SUMMARY

In some embodiments, an ultrasound-assisting quenching process and a device for performing the same can help to improve the mechanical property and extend the life of the workpiece.

In some embodiments, an ultrasound-assisting quenching process includes the following steps:

S1) connect the workpiece with the ultrasonic unit tightly;

S2) heat the workpiece to the quenching temperature and then hold for a period of time;

S3) start the ultrasonic unit, then the ultrasonic energy can be injected into the workpiece directly, and the frequency of the ultrasound generated by the ultrasonic unit is close to the self-frequency of the workpiece.

S4) put the workpiece into the coolant quickly to make the workpiece to be quenched.

In this invention, $-500\ \text{Hz} \le f_1 - f_2 \le 500\ \text{Hz}$, where $f_1$ is the frequency of the ultrasound, $f_2$ is the self-resonant frequency of the workpiece (4). Therefore, the workpiece can be resonated during the whole quenching process.

An ultrasound-assisting quenching device is designed. This device includes two units: one is the heating unit used to heat the workpiece (4), and the other is the ultrasonic unit. The ultrasonic unit connects with the workpiece tightly.

The ultrasonic unit includes an ultrasound generator (1), a transducer (2) and an amplifier (3), all of them are connected with each other in this order.

This ultrasound generator includes an automatic frequency-tracking controller, which is able to maintain the deviation of the system resonant frequency at +500 Hz.

The advantages of this invention when compared with the conventional quenching process are:

The ultrasound energy is injected into the workpiece directly during the quenching process, which can make the internal atoms of the workpiece to be vibrated with a high frequency. The vibration of the atoms can cause the lattice of the martensite phase and austenite phase to be distorted and generate the elastic distortion energy. This elastic distortion energy can increase the driving force for the transformation from the austenite to martensite. Therefore, the ultrasonic vibration can improve transformation from the austenite to the martensite and decrease the size of the martensite and the content of the retained austenite, which can not only greatly improve the strength and hardness, but also enhance the plasticity and extend the life of the workpiece.

Compared with the electromagnetic assisted quenching process, the frequency of the ultrasound is higher than that of the electromagnetic field. Generally, the frequency of the ultrasound is larger than 20 kHz, and the frequency of the electromagnetic field used for quenching process is about 10~100 Hz. Therefore, compared with the ultrasound-assisting quenching process and the electromagnetic-assisted quenching process, the ultrasound-assisting quenching process should have a better quenching effect.

BRIEF DESCRIPTION OF DRAWINGS

The present invention will become more fully understood from the detailed description given here in below and the accompanying drawings which are given by way of illustration only, and thus are not limitative of the present invention and wherein:

FIG. 1 is a schematic view of a device that can perform an ultrasound-assisting quenching process.

DETAILED DESCRIPTION

In order to clearly understand about the process characteristics, aim and the effects of this invention, here are some preferential embodiments to express this process and device based on the FIGURE.

The invention provides a novel ultrasound-assisting quenching process, which include the following steps:

S1) connect the workpiece with the ultrasonic unit tightly. There are lots of ways can be chosen, such as threaded connection, buckled connection and so on. In this case, threaded connection is selected since it can be kept tight and be operated easily.

S2) heat the workpiece to the quenching temperature and then hold for a period of time. The quenching temperature and holding time for this process are the same as that in the conventional quenching process.

S3) start the ultrasonic unit, then the ultrasound energy can be injected into the workpiece directly. To ensure the workpiece can be resonated under the effect of ultrasound and make the internal atoms of the workpiece to be vibrated with a high frequency, the frequency of the ultrasound $f_1$ should be close to the self-resonant frequency of the workpiece $f_2$. In this invention, $-500\ Hz \leq f_1 - f_2 \leq 500\ Hz$, most preferably, $f_1$ is equal to $f_2$. In some embodiments, for a workpiece made of a particular type of material, the size and the shape of the workpiece can be changed to helps adjust the self-resonant frequency of the workpiece $f_2$, thereby allowing the self-resonant frequency $f_2$ of the workpiece to be close to the frequency $f_1$ of the ultrasound.

The temperature of workpiece will be reduced and the self-resonant frequency can also be changed in a small range during quenching process. So, a frequency tracker is required for the ultrasonic unit to ensure continuous resonance when frequency changes because of temperature changing. Therefore, the internal atoms of the workpiece can be resonated in a high frequency during the whole quenching process.

S4) put the workpiece into the coolant quickly to make the workpiece to be quenched. During the whole quenching process, the ultrasonic unit should be kept on. The coolant, cooling temperature and cooling time are the same as that in the conventional quenching process.

Because ultrasound energy is injected into the workpiece, the internal atoms of the workpiece will be resonated in a high frequency, which cause the lattice of the martensite phase and austenite phase to be distorted and generate the elastic distortion energy. All of these can improve the driving force from austenite phase to martensite phase, and then promote the transformation from austenite phase to martensite phase, decrease retained austenite and refine the martensite phase. It can not only increase the hardness and strength of the workpiece, but also increase the plasticity and extend the service life of the workpiece.

FIG. 1 illustrates a device used for the ultrasound-assisting quenching process, which includes two units: one is the heating unit (5) used to heat the workpiece (4) and hold the temperature for a period of time, and the other is the ultrasonic unit. Connect the workpiece (4) with the ultrasonic unit tightly. There are lots of ways to be selected to connect these two parts, for example threaded connection, buckled connection. Threaded connection is the first choose since it can be kept tight and be operated easily In this invention, ultrasound energy is directly injected into the workpiece (4) and then quenched. With the assistance of the ultrasound energy, refined crystalline grain can be obtained, which can not only increase the hardness and strength of the workpiece (4) but also increase the plasticity and extend the life of the workpiece. To ensure the workpiece (4) can be resonated under the effect of ultrasound and make the internal atoms of the workpiece (4) to be vibrated in high frequency, the frequency of the ultrasound $f_1$ should be close to the self-resonant frequency of the workpiece (4) $f_2$. In this invention, $-500\ Hz \leq f_1 - f_2 \leq 500\ Hz$, most preferably, $f_1$ is equal to $f_2$.

The temperature of workpiece (4) will be reduced and the self-resonant frequency can also be changed in a small range during quenching process. A frequency tracker is used in ultrasound generator (1) to ensure continuous resonant when frequency changes because of temperature changing. During the whole quenching process, the internal atoms of the workpiece (4) can be resonated in a high frequency all the time.

What is more, the ultrasonic unit includes ultrasound generator (1), transducer (2) and amplifier (3). The ultrasonic vibration generator (1) can generate high-frequency impulse electrical signal and then the signal will be transferred into transducer (2). Transducer (2) can change high-frequency impulse electrical signal into high-frequency mechanical vibration, and amplifier (3) can enlarge the mechanical vibration to obtain homogeneous ultrasound. Connect the workpiece (4) with amplifier (3) tightly, so the ultrasound energy can be directly injected into the workpiece (4).

The described embodiments are to be considered in all respects only as illustrative and not restrictive. The scope of the invention is therefore, indicated by the appended claims rather than by the foregoing description. All changes which come within the meaning and range of equivalency of the claims are to be embraced within their scope.

The invention claimed is:

1. An ultrasound-assisting quenching process, comprising:

S1) connecting a workpiece with an ultrasonic unit;

S2) heating the workpiece to a quenching temperature and then holding for a period of time;

S3) starting the ultrasonic unit, injecting ultrasound energy into the workpiece directly, wherein a relationship between a frequency of the ultrasound generated by the ultrasonic unit and a self-frequency of the workpiece is $-500\ Hz \leq f_1 - f_2 \leq 500\ Hz$, where $f_1$ is the frequency of the ultrasound, and $f_2$ is the self-resonant frequency of the workpiece;

S4) putting the workpiece into a coolant quickly to allow the workpiece to be quenched.

* * * * *